US005822925A

United States Patent [19]

McKinney et al.

[11] Patent Number: 5,822,925

[45] Date of Patent: Oct. 20, 1998

[54] HOOK-MOUNTED HINGE MECHANISM FOR OVEN DOORS

[75] Inventors: Michael McKinney, Hamilton County; Scott Williams, Hancock County, both of Ind.

[73] Assignee: Maytag Corporation, Newton, Iowa

[21] Appl. No.: 554,827

[22] Filed: Nov. 7, 1995

[51] Int. Cl.[6] ..... E05F 1/10; F23M 7/00

[52] U.S. Cl. ..... 49/386; 126/194; 126/197

[58] Field of Search ..... 126/194, 190, 126/197, 198, 192; 312/319.1, 319.2, 327, 328; 49/386, 387; 16/321, 322, 334, 344

[56] References Cited

U.S. PATENT DOCUMENTS

| | | | |
|---|---|---|---|
| 2,281,018 | 4/1942 | Barnsteiner et al. | 126/194 |
| 2,833,270 | 5/1958 | Brown et al. | 126/194 |
| 3,003,495 | 10/1961 | Coultrip | 126/194 |
| 3,144,863 | 8/1964 | Pollack | 126/191 |
| 3,450,125 | 6/1969 | Hopkins | 126/194 |
| 3,677,259 | 7/1972 | Doner | 126/194 |
| 3,712,287 | 1/1973 | Summers, Jr. | 126/191 |
| 3,749,080 | 7/1973 | Kleinhenn | 126/194 |
| 3,838,538 | 10/1974 | Burford | 49/258 |
| 3,842,542 | 10/1974 | White et al. | 49/386 |
| 3,877,460 | 4/1975 | Lotz et al. | 126/200 |
| 3,927,658 | 12/1975 | Olthuis | 126/214 |
| 3,955,865 | 5/1976 | Wilson | 312/319 |
| 4,021,968 | 5/1977 | Kendall | 49/386 |
| 4,138,988 | 2/1979 | Hurley | 126/194 |
| 4,163,344 | 8/1979 | Scherer | 49/386 |
| 4,269,165 | 5/1981 | Wrotny et al. | 126/194 |
| 4,287,873 | 9/1981 | Goins et al. | 126/194 |
| 4,315,495 | 2/1982 | Jellies | 126/194 |
| 4,665,892 | 5/1987 | Spargo et al. | 126/194 |
| 4,817,240 | 4/1989 | Sovis, Jr. et al. | 16/297 |
| 5,025,776 | 6/1991 | Hanley et al. | 126/194 |

FOREIGN PATENT DOCUMENTS

| | | | |
|---|---|---|---|
| 632180 | 1/1995 | European Pat. Off. | 126/194 |
| 2830976 | 2/1979 | Germany | 126/194 |

*Primary Examiner*—Daniel P. Stodola
*Assistant Examiner*—Curtis A. Cohen
*Attorney, Agent, or Firm*—Brinks Hofer Gilson & Lione

[57] ABSTRACT

A door hinge mechanism is easily fastened to an oven door at its top and bottom, for example, using a hook-like engagement, and providing along the length of the oven door sidewalls rigid structural members and support, and thermal isolation of the oven door sidewalls from the oven door interior.

16 Claims, 4 Drawing Sheets

HOOK-MOUNTED HINGE MECHANISM FOR OVEN DOORS

The present invention relates to hinge mechanism for use with oven doors and the like, and particularly to hinge mechanisms mounted inside an interior region of the oven door.

BACKGROUND OF THE INVENTION

The development of improved oven door mounting and hinge systems has received extensive attention by those working to improve oven appliances. Such efforts are exemplified by U.S. Pat. Nos. 3,003,495; 3,144,863; 3,677,259; 3,712,287; 3,838,538; 3,842,542; 3,877,460; 3,927,658; 3,955,865; 4,021,968; 4,138,988; 4,163,344; 4,287,873; 4,665,892; 4,817,240; and 5,025,776. None of the oven door mounting and hinge systems disclosed in these many patents is entirely satisfactory.

For example, U.S. Pat. No. 5,025,776 to Hanley, et al. discloses a spring coupled to a U-shaped framework which is riveted in position adjacent a door edge and extends partially along the door edge. Hanley requires special equipment, i.e., rivet guns, to install the hinge mechanism in the door. Moreover, because of the fastening means used, removal and replacement by a technician in the field is more complicated, and requires that the technician carry special tools, such as drills and rivet guns, to remove the old rivets and replace them with new. Moreover, Hanley's hinge mechanism does not provide substantial additional structural support to the oven door or materially improve heat transfer characteristics of the oven door.

SUMMARY OF THE INVENTION

Unlike the prior disclosed oven door mounting and hinge systems, the invention provides a novel hinge mechanism that can be inexpensively manufactured, that can be installed, removed, and replaced easily using ordinary screwdrivers or the like, that provides additional structural strength to the door, that reduces heat transfer between the interior region of the door and the door edges, and that, with its improved structural support and reduced heat-transfer, permits larger viewing windows to be installed in the oven doors in response to consumer preferences.

The invention provides a door hinge mechanism easily fastened to a wall forming the oven door at its top and bottom, for example, using a hook-like engagement, and providing along the length of the oven door side walls rigid structural members and support, and thermal isolation of the oven door sidewalls from the over door interior.

A preferred hook-mounted hinge assembly of the invention can be provided for use with an oven door or the like that includes a outer panel and a door liner that cooperate to define an interior region, and where the door liner includes a pair of sidewalls, a top wall, and a bottom wall. The top wall can include tabs with hook-receiving apertures, and the bottom wall can include tabs with fastener-receiving apertures, and the hinge mechanism can compare a channel member having a back wall and a pair of parallel channel walls extending along the length of the back wall and cooperating with the back wall to define a U-shaped channel. A first end of the channel member can include at least one hook for engaging the hook-receiving apertures to attach the first end of the channel member to the door liner, and a second end of the channel member can include a tab having a plurality of apertures which align with the fastener-receiving apertures in the bottom wall and receive fasteners that attach the second end of the channel member to the door liner. A mounting plate is pivotally attached to the second end of the channel member and extends through a slot formed in the door liner to engage the oven and retain the door on the oven. The mounting plate includes a plurality of retaining pin-receiving notches.

Such a channel member is positioned in abutment with a sidewall of the door liner so that the U-shaped channel and door liner cooperate to define an enclosed region within the interior region. A spring is disposed within the enclosed area, having a first end coupled to the channel walls and a second end coupled to a spring tensioner which, in turn, is pivotally coupled to the mounting plate.

The channel member is disposed within the interior region adjacent a sidewall of the door liner and extends along the length of the sidewall. Positioning the channel member adjacent and coextensive with the sidewall provides increased structural support to the door and reduces the heat transfer between the interior region and the sidewall.

In the invention, a hinge pocket member can be disposed adjacent the oven cavity to receive the mounting plate for attaching the oven door to the oven. The hinge pocket member includes a plurality of retaining pins that are positioned to engage the plurality of notches formed on the mounting plate.

Additional features and advantages of the invention will become apparent to those skilled in the art upon consideration of the following detailed description of a preferred embodiment exemplifying the best mode of carrying out the invention as presently perceived.

DETAILED DESCRIPTION OF THE DRAWINGS

Figure 1A:
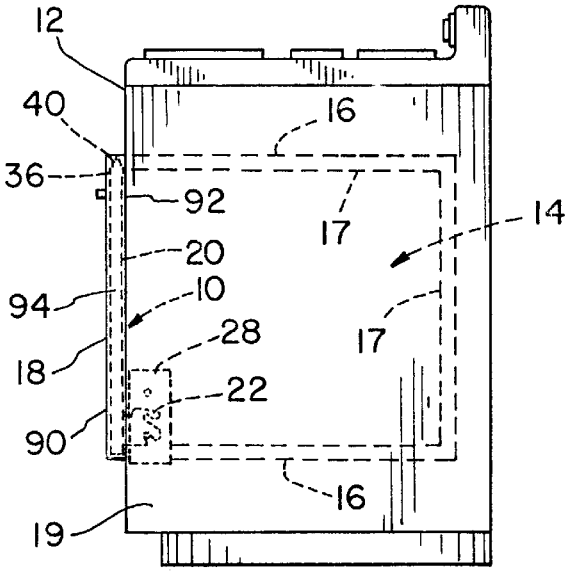
FIG. 1A is a side view of a stand-alone oven showing a hook-mounted hinge mechanism (shown in phantom) in position in the oven door and the pocket member adjacent the oven cavity.
Figure 1B:
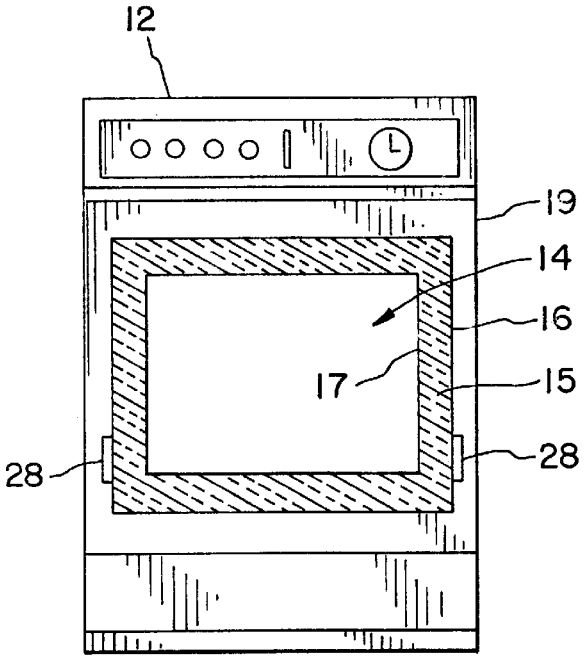
FIG. 1B is a front view of the stand-alone oven of FIG. 1A, with the oven door removed, illustrating the position of the pocket member between the outer wall surrounding the oven cavity and the exterior wall of the stand-alone oven.

A hinge mechanism 10 according to the present invention can be used with an oven 12 having an oven cavity 14 defined by a plurality of inner walls 17 which are, in turn, surrounded by a plurality of outer walls 16. Insulating material 15 can be disposed between the inner and outer walls to provide a thermal barrier for retaining heat in the oven cavity 14. An oven door 18 is positioned to close the oven cavity 14. The oven cavity 14 can be installed as a built-in appliance or as a stand-alone appliance. In the case of the stand-alone appliance, as shown in Figs. 1A–1B, a plurality of exterior beauty walls 19 surround the cavity 14 and inner and outer walls 17, 16.

Figure 4:
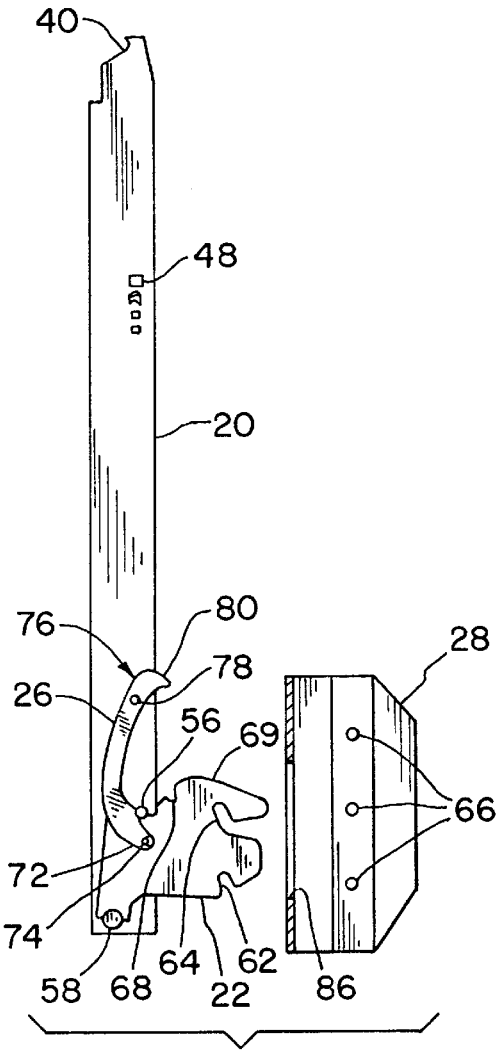
FIG. 4 is a section view of the mechanism of FIG. 2 taken along lines 4—4 in FIG. 2 with the mounting plate in position to enter the pocket member.
Figure 5:
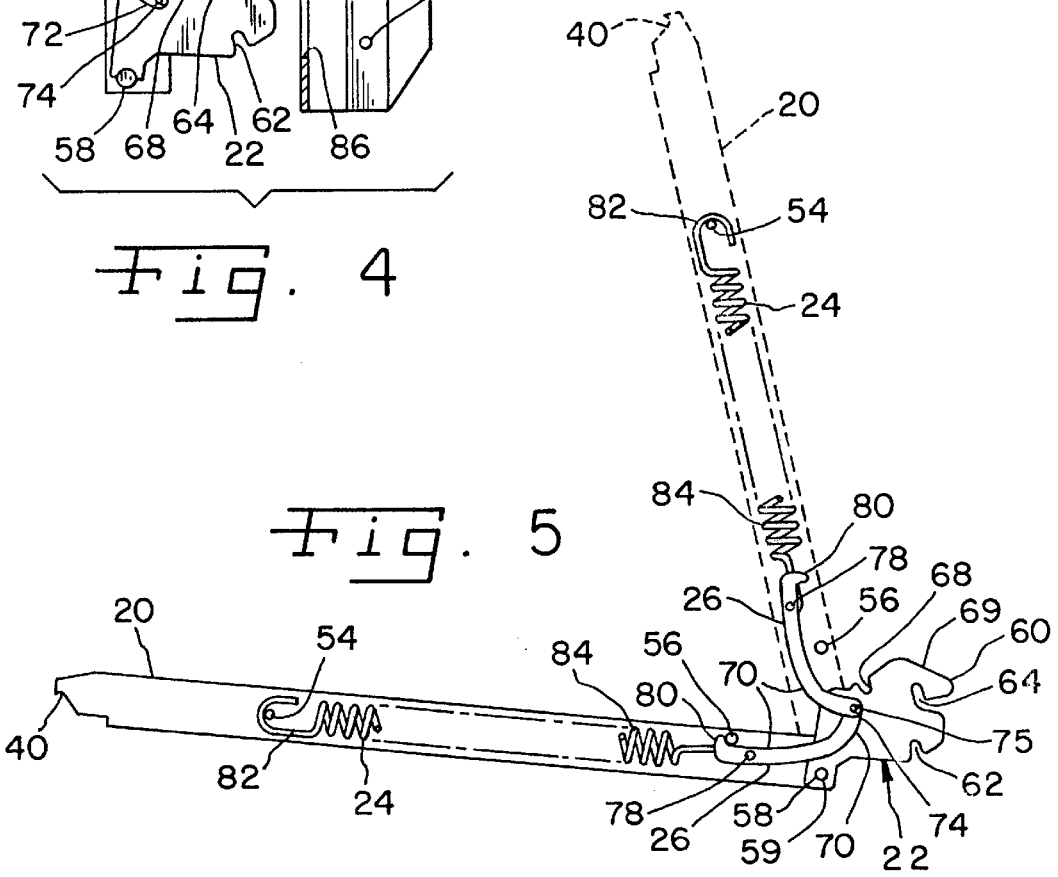
FIG. 5 is a sectional view of the mechanism illustrating the hinge mechanism in a partially open position (dotted lines) and in a fully open position (solid lines)
Figure 6:
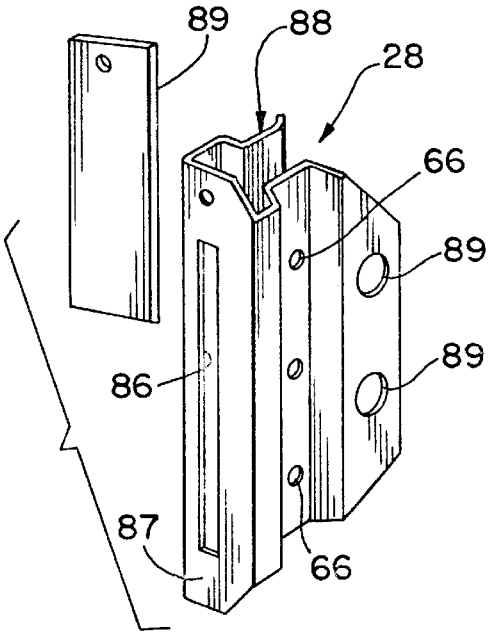
FIG. 6 is a perspective view of the pocket member.
Figure 7:
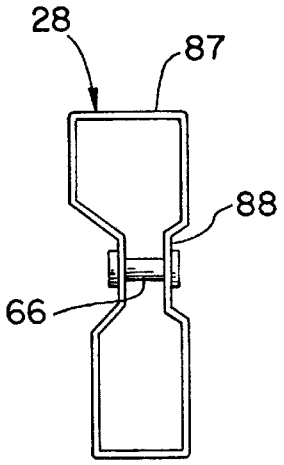
FIG. 7 is a top view of the pocket member with retaining pins extending across a narrow width portion of the pocket member.

The hinge mechanism 10 couples the oven door 18 to the oven 12. The hinge mechanism 10 includes a channel member 20, a mounting plate 22, a spring 24, and a spring tensioner 26 (FIGS. 2–3 and 5), and a hinge pocket member 28 (FIGS. 4, 6 and 7). The channel member 20, the mounting plate 22, the spring 24, and the spring tensioner 26 are attached to the oven door 18, while the hinge pocket member 28 is attached to the oven cavity 14 adjacent and exterior to the outer walls 16. The general placement of the hinge mechanism 10 in the oven door 18 and oven 12 is shown in phantom in FIG. 1.

Figure 8:
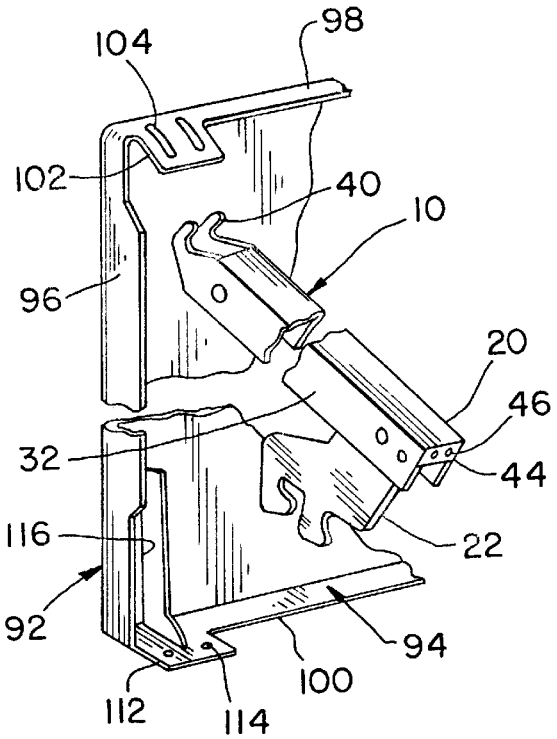
FIG. 8 is a perspective view showing the channel member and mounting plate in position to be installed on a door liner.
Figure 9:
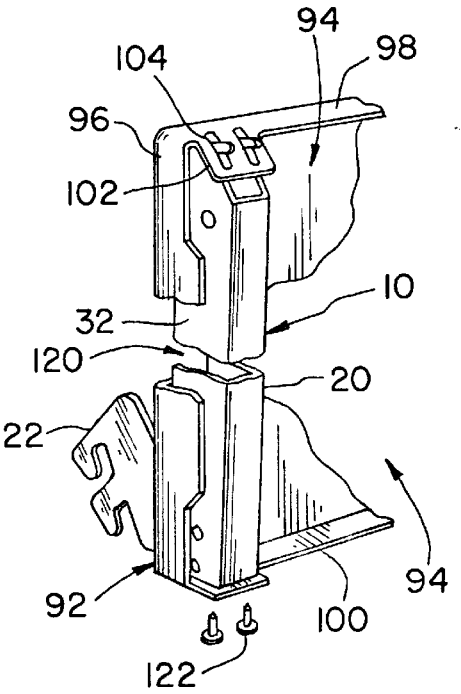
FIG. 9 is a perspective view of the channel member in position against the door liner with the mounting plate extending through the door liner.

The channel member 20 has a top end 20*a* and a bottom end 20*b* and includes a back wall 30 and a pair of parallel channel walls 32 extending along the length of the back wall 30 and cooperating with the back wall 30 to define an open U-shaped channel 34. The top end of each channel wall 32 is formed to include a hook 40 disposed to open away from the open U-shaped channel 34 and toward the back wall 30 (FIGS. 8–9). The bottom end of the back wall 30 is formed to include a tab 44 that is bent orthogonally to the back wall 30 so as to partially close the bottom end of the U-shaped channel 34. The tab 44 includes fastener-receiving apertures 46. The channel walls 32 also include a plurality of apertures 48, 50, 52 for receiving a spring-retaining pin 54, a stop pin 56, and a pivot pin 58, respectively.

The mounting plate 22 (FIGS. 3–5) is pivotally attached to the bottom end of the channel member 20 by the pivot pin 58 which extends between the channel walls 32 to form pivot axis 59. The mounting plate 22 includes a flat plate portion 60 extending outwardly from the pivot pin 58 through the open U-shaped channel 34 and having first and second notches 62, 64 for receiving hinge retaining pins 66 on the hinge pocket 28 (FIG. 6) which will hold the hinge mechanism 10 in position on the oven 12. A locking notch 68 is formed on the top edge 69 of the flat plate portion 60.

Figure 2:
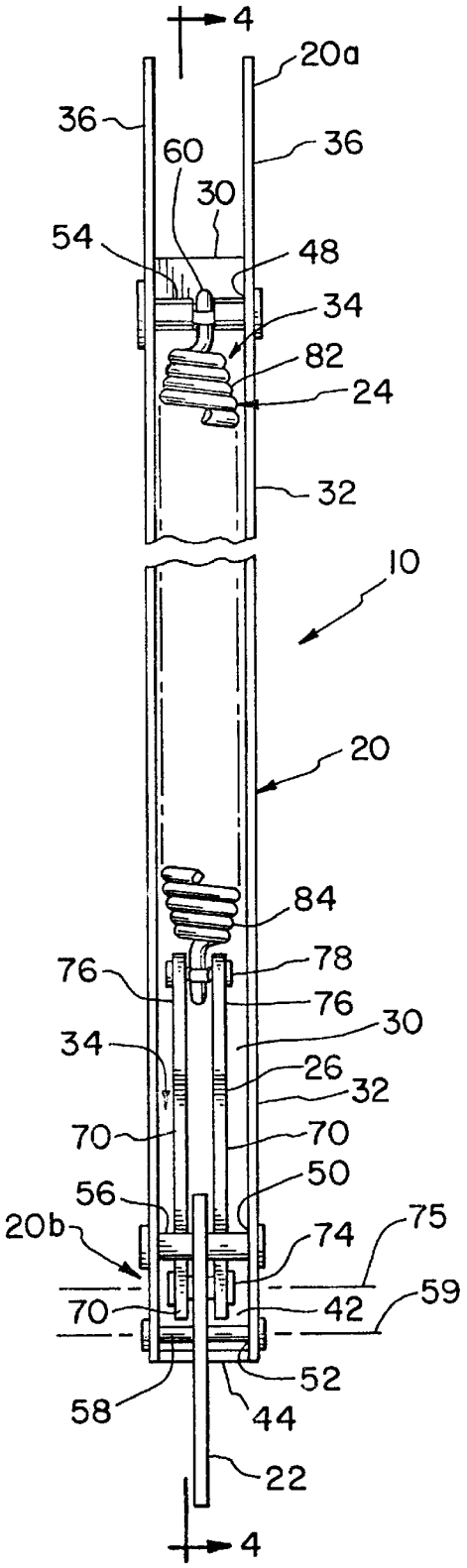
FIG. 2 is non-enclosed side view of the hinge mechanism and illustrates the spring tensioner attaching one end of the spring to the mounting plate, with the other end of the spring attached to the channel member.
Figure 3:
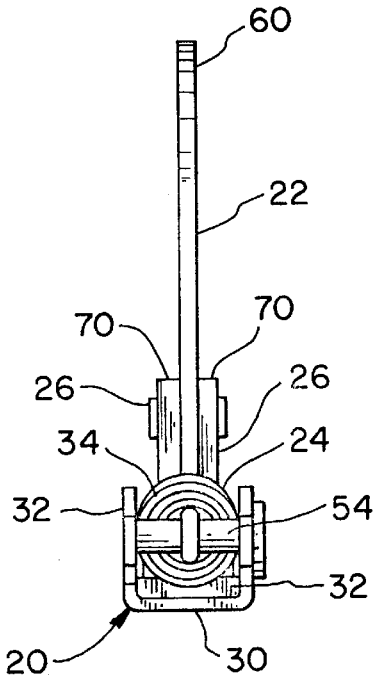
FIG. 3 is a top view of the mechanism of FIG. 2.

The spring tensioner 26 (FIGS. 2–5) includes a pair of elongated, slightly curved members 70. The curved members 70 are disposed in parallel relation on opposite sides of the mounting plate 22, as best shown in FIG. 3. The bottom ends 72 of the curved members 70 are pivotally coupled to the mounting plate 22 by a pivot pin 74, which forms pivot axis 75, as shown in FIGS. 2, 4 and 5. The upper ends 76 of the curved members 70 are coupled to each other by a spring-receiving pin 78 passing through the upper ends 76. The upper ends 76 further include tip portions 80 (FIGS. 4–5) that are generally hook-shaped. The tip portions 80 are configured to engage the stop pin 56 when the door 18 has reached the fully open position, as shown in solid lines in FIG. 5, and prevent further movement of the door 18 beyond the fully open position.

As illustrated in FIGS. 2,3, and 5, the spring 24 is disposed in the U-shaped channel 34 with a first end 82 generally held in position relative to the channel walls 32 by spring-retaining pin 54. A second end 84 of the spring 24 is coupled to the spring tensioner 26 by the spring-receiving pin 78 and is free to extend longitudinally within the U-shaped channel 34.

The pivot axis 75 is offset from pivot axis 59 so that, as the door 18 is pivoted about axis 59, the spring-retaining pin 54 moves away from pivot axis 75. The spring-retaining pin 54 holds the top end of the spring 24 in position relative to the channel walls 32 while the spring tensioner 26 rotates about the pivot pin 74, thereby extending the second end 84 of the spring 24 and stretching spring 24.

The hinge pocket member 28, shown in FIGS. 6–7, is formed to include a generally rectangular cross section with a central area 88 having a reduced width. The hinge pocket member 28 can be formed from a single piece of metal or from a pair of generally L-shaped pieces that are assembled to form the pocket member 28. A plurality of hinge-retaining pins 66 extend across the hinge pocket member 28 at the central area 88, and a mounting plate-receiving slot 86 is formed in a front face 87 of the hinge pocket member 28. The hinge-retaining pins 66 are spaced apart to be received by the notches 62, 64 and thereby retain the mounting plate 22. The hinge pocket member 28 also includes a locking plate 89 sized and configured to cover a portion of the mounting plate-receiving slot 86 and engage the locking notch 68 on the mounting plate 22. A plurality of locking plate 89 can be formed in the hinge pocket member 28 for receiving fasteners to attach the hinge pocket member 28 to the oven 12. In use, a hinge pocket member 28 is positioned exterior to the outer walls 16.

Figure 10:
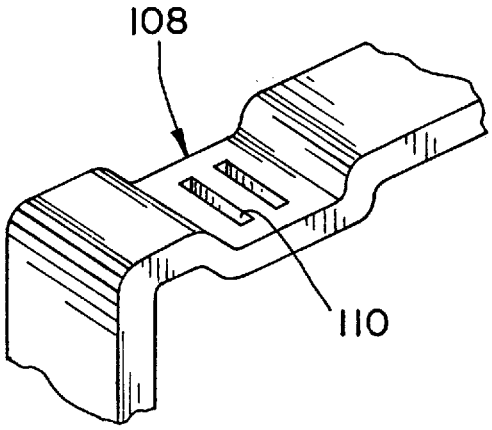
FIG. 10 is a perspective view of an alternative embodiment of the apertures formed on the door liner for retaining the channel member.

The hinge mechanism 10 of the present invention can be used with an oven door 18 having an outer panel 90 and an inner door liner 92 that cooperate to form an interior region 94 (FIGS. 1, 8 and 9). As indicated by FIGS. 8 and 9, the door liner 92 includes a pair of sidewalls 96, a top wall 98 and a bottom wall 100. The top wall 98 is formed to include a pair of tabs 102, wherein each tab 102 includes a pair of hook-receiving apertures 104. The tabs 102 extend from the top wall 98 and are bent downwardly from the plane of the top wall 98 so as to be positioned within the interior region 94. The tabs 102 are positioned at the ends of the top wall 98 so as to be adjacent the sidewalls 96. (FIG. 10 shows an alternative tab configuration 108 having hook-receiving apertures 110.) The bottom wall 100 includes a tab 112 that extends in the plane of the bottom wall 100 and includes a pair of fastener receiving apertures 114. Tab 112 is aligned under the tab 102 (or 108). A mounting plate slot 116 is formed in the door liner 92 and aligned between the tabs 102 and 112. The slot 116 is sized to allow the mounting plate 22 to pass through the door liner 92 and extend away from the door 18 to engage the hinge pocket 28. The slot 116 can extend into the bottom wall 100 as necessary to accommodate the mounting plate 22, as shown in FIG. 8.

FIG. 8 shows an assembled hinge mechanism 10 in position for assembly in the interior region 94. The hooks 40 formed at the top ends of the channel walls 32 are inserted into the apertures 104 from underneath, as illustrated, and the channel member 20 is rotated about the hook/aperture engagement to position the channel walls 32 against the door liner 92, as illustrated in FIG. 9. When a channel member 20 has been positioned as in FIG. 9, fasteners 122, such as screws or the like, are passed through the fastener receiving apertures 114 in the bottom wall 100 and fastener receiving apertures 46 formed in the tab 44 on the channel member 20 to rigidly attach the bottom end 20*b* of the channel member 20 to the door liner 92. Thus, the top end 20*a* is held in position by the hooks 40, the bottom end 20*b* is held in position by fasteners 122. The channel members 20, when assembled with the door liner 92, extend along the entire length (height) of the sidewalls 96 of the door liner 92, providing added structural strength to the door 12.

Additionally, the door liner 92 cooperates with the U-shaped channel 34 formed by the channel members 20 to define an enclosed region 120 within the interior region 94 which encloses the spring 24 and spring tensioner 26. Positioning the channel members 20 against the sidewalls 96 also reduces the heat transfer between the interior region 94 and the sidewalls 96. The channel members 20 act as heat sinks and provide an air gap between the interior region 94 and the sidewalls 96.

With the channel members 20 in position against the door liner 92, the mounting plates 22 extend outwardly from the door 12 toward the oven 12, as shown in FIG. 9. The door 18 is positioned against the oven 12 with the mounting plates 22 extending into the mounting plate-receiving slots 86 to position the notches 62, 64 for engagement with the hinge-retaining pins 66. When the notches 62, 64 are engaged with the hinge-retaining pins 66, the locking plates 89 are positioned to cover the mounting plate-receiving slots 86 and engage the locking notch 68 formed on the mounting plate 22 to keep the notches 62, 64 from disengaging from the hinge-retaining pins 66. The locking plates 89 are fastened to the front face 87 of the hinge pocket member 28 by screws or other removable fasteners. Advantageously, removal of the locking plates permit easy removal of the entire door 18 and hinge (less the hinge pocket member 28) for repair or replacement.

Although the invention has been described in detail with reference to a particular preferred embodiment, variations and modifications exist within the scope and spirit of the invention as described and defined in the following claims.

We claim:

1. A door hinge mechanism used with an oven door having an outer panel and a door liner cooperating to define an interior region having a height and a width, the door liner including a plurality of sidewalls, a top wall, and a bottom wall, the mechanism comprising:

means for coupling the hinge mechanism to an oven;

a resilient member disposed inside the interior region;

means coupled to the resilient member for stretching the resilient member in response to movement of the door from a closed position to an open position; and means extending along the height of the door liner and cooperating with the door liner for enclosing the resilient member within the interior region, said enclosing means including a channel member having a first end formed to include hook means for attaching the enclosing means to the door liner, said hook means including a hook opening away from the door liner, and said door liner including an aperture for receiving the hook.

2. The mechanism of claim 1 wherein the channel member includes a back wall and pair of parallel channel walls extending orthogonally from the back wall to define a U-shaped channel, the channel walls being positioned in abutment with the door liner to provide structural support to the door liner, the U-shaped channel being oriented to face the door liner when the hook is received by the aperture.

3. The mechanism of claim 1 wherein the enclosing means is disposed adjacent a sidewall and includes means for reducing thermal heat transfer between the interior region and the sidewall adjacent the enclosing means.

4. The mechanism of claim 1 wherein the stretching means includes a spring tensioner pivotally coupled to the coupling means.

5. The mechanism of claim 4 further including stop means coupled to the enclosing means for engaging the spring tensioner to prevent the oven door from opening beyond a fully open position, the fully open position being predetermined by the placement of the stop means relative to the spring tensioner.

6. The mechanism of claim 5 wherein the spring tensioner is formed to include a tip end and the stop means includes a stop pin and the tip end engages the stop pin when the oven door reaches the open position.

7. A door hinge mechanism used with an oven door having an outer panel and a door liner cooperating to define an interior region having a height and a width, the door liner including a plurality of sidewalls, a top wall, and a bottom wall, the mechanism comprising:

means for coupling the hinge mechanism to an oven;

a resilient member disposed inside the interior region;

means coupled to the resilient member for stretching the resilient member in response to movement of the door from a closed position to an open position, said coupling means including a mounting plate pivotally coupled to the enclosing means, the mounting plate including a plurality of retaining pin-engaging notches;

means extending along the height of the door liner and cooperating with the door liner for enclosing the resilient member within the interior region; and a hinge pocket having a mounting plate-receiving slot and a plurality of retaining pins for engaging the retaining pin-engaging notches, the hinge pocket being disposed adjacent an outer wall surrounding an oven cavity.

8. The mechanism of claim 7 wherein the hinge pocket is oriented to expose the mounting plate-receiving slot to the mounting plate, said mounting plate being configured to extend through the door liner and into the mounting plate-receiving slot to position the notches for engagement with the retaining pins.

9. The mechanism of claim 8 wherein the hinge pocket further includes locking plate means for retaining the mounting plate in engagement with the retaining pins.

10. A door hinge mechanism used with a door having an outer panel and a door liner cooperating to define an interior region having a length and a width, the door liner including a plurality of sidewalls, a top wall, a bottom wall, the mechanism comprising:

a spring disposed in the interior region and coupled to the door liner for urging the door to a closed position;

a heat transfer barrier positioned adjacent a first sidewall and extending along the length of the sidewall for reducing heat transfer between the interior region and the first sidewall; and a hook for attaching with a pivotal coupling arrangement the heat transfer barrier to the door liner;

wherein the door liner further includes a tab extending into the interior region for attaching the heat transfer barrier to the door liner, the tab being formed to include an aperture positioned and configured to engagably receive the hook.

11. The mechanism of claim 10 wherein the heat transfer barrier includes a U-shaped channel, the U-shaped channel being attached to and cooperating with the door liner to form an enclosed region within the interior region, the spring being disposed within the enclosed region.

12. The mechanism of claim 11 wherein the U-shaped channel includes a first end formed to include the hook.

13. An oven door hinge used with an oven door having a front panel and a door liner cooperating to define an interior region, the door liner including a pair of sidewalls, a top wall, and a bottom wall, the hinge comprising:

a spring coupled to the door liner for urging the oven door from an open position to a closed position;

a structural support member extending along the length of and adjacent one of the sidewalls for providing structural support for the oven door, said structural support member including a plurality of hooks; and a plurality of apertures formed in the door liner for engagably receiving the hooks to retain the structural support member in abutment with the door liner.

14. An oven door hinge mechanism used with an oven having inner and outer walls surrounding an oven cavity and an oven door, the oven door having an outer panel and a door liner cooperating to define an interior region having a length and a width, the door liner including a plurality of sidewalls, a top wall, and a bottom wall, the mechanism comprising:

a pocket-forming member including a plurality of retaining pins, the pocket-forming member being attached to the oven cavity adjacent the outer walls; and a mounting plate pivotally coupled to the oven door and extending into the pocket-forming member for engaging the retaining pins to attach the oven door to the oven.

15. The mechanism of claim 14 wherein the mounting plate includes a plurality of notches sized and configured to receive the retaining pins.

16. The mechanism of claim 15 further including a spring coupled to the oven door and a spring tensioner coupling the spring to the mounting plate.

* * * * *